United States Patent [19]

Suzuki et al.

[11] 4,077,209

[45] Mar. 7, 1978

[54] EXHAUST GAS REBURNING SYSTEM

[75] Inventors: Suzuo Suzuki, Yokohama; Akio Isobe; Kenichi Matsuda, both of Yokosuka, all of Japan

[73] Assignee: Nissan Motor Company, Limited, Japan

[21] Appl. No.: 642,775

[22] Filed: Dec. 22, 1975

[30] Foreign Application Priority Data

Dec. 23, 1974 Japan ..... 49-147891

[51] Int. Cl.[2] ..... F01N 3/10

[52] U.S. Cl. ..... 60/282; 60/289; 60/323

[58] Field of Search ..... 60/282, 323, 289

[56] References Cited

U.S. PATENT DOCUMENTS

| | | | |
|---|---|---|---|
| 3,413,803 | 12/1968 | Rosenlund | 60/282 |
| 3,785,153 | 1/1974 | Schwing | 60/282 |
| 3,839,862 | 10/1974 | Gota | 60/282 |
| 3,869,858 | 3/1975 | Goto | 60/290 |
| 3,898,802 | 8/1975 | Tadokoro | 60/282 |
| 3,934,411 | 1/1976 | Masaki | 60/282 |
| 3,934,412 | 1/1976 | Masaki | 60/289 |

*Primary Examiner*—Douglas Hart

*Attorney, Agent, or Firm*—Lowe, King, Price & Markva

[57] ABSTRACT

An exhaust gas reburning device comprises a first reaction chamber receiving only rich HC and CO containing engine exhaust gases resulting from combustion of a rich air-fuel mixture having an air-fuel ratio lower than a stoichiometric air-fuel ratio to cause effective oxidation of rich HC and CO in the engine exhaust gases and a second reaction chamber separated from the first reaction chamber and receiving the resultant engine exhaust gases from the first reaction chamber and poor HC and CO containing engine exhaust gases resulting from combustion of a lean air-fuel mixture having an air-fuel ratio higher than the stoichiometric air-fuel ratio to effect sufficient oxidation of lean HC and CO in the engine exhaust gases of the lean air-fuel mixture and the remaining HC and CO in the resultant engine exhaust gases from the first reaction chamber by heat of the resultant exhaust gases and oxygen in the lean HC and CO engine exhaust gases.

13 Claims, 4 Drawing Figures

EXHAUST GAS REBURNING SYSTEM

The present invention relates generally to an exhaust gas purifying device for an internal combustion engine in which one group of combustion chamber or chambers are fed or filled with a rich air-fuel mixture having an air-fuel ratio lower than a stoichiometric air-fuel ratio and the other group of combustion chamber or chambers are fed or filled with a lean air-fuel mixture having an air-fuel ratio higher than the stoichiometric air-fuel ratio, and particularly to an improved exhaust gas thermal reactor, for an engine of this type, in which two separate reaction chambers are provided to receive respectively thereinto rich HC and CO containing engine exhaust gases resulting from combustion or the rich air-fuel mixture and poor HC and CO containing engine exhaust gases resulting from combustion of the lean air-fuel mixture so that after the rich HC and CO containing exhaust gases have been reacted to a certain degree in one reaction chamber, the resultant engine exhaust gases are mixed with the poor HC and CO containing exhaust gases in the other reaction chamber to burn the remaining HC and CO contained in the mixed engine exhaust gases.

As is well known in the art, it is very difficult to treat nitrogen oxides in air pollutants discharged from an internal combustion engine. An exhaust gas reburning device such as a thermal reactor incorporated into the exhaust system of the engine cannot be expected the effect of greatly reducing the content of nitrogen oxides contained in exhaust gases discharged from the engine. Accordingly, it is most effective for reducing the amount of nitrogen oxides contained in the engine exhaust gases to make the amount of nitrogen oxides produced by combustion in the engine combustion chamber as not much as possible.

It is recognized that the amount of nitrogen oxides produced by combustion is increased as the combustion approaches perfect combustion. In other words, the production of nitrogen oxides is maximum when the air-fuel ratio of the air-fuel mixture burned in the engine combustion chamber is equal to or near a stoichiometric air-fuel ratio. Accordingly, in order to reduce the amount of nitrogen oxides produced by combustion, it is desirable for the engine to employ a rich or lean air-fuel mixture having an air-fuel ratio lower or higher than the stoichiometric air-fuel ratio.

When the engine employs the rich or lean air-fuel mixture, the rich air-fuel mixture produces exhaust gases containing large quantities of hydrocarbons and carbon monoxide as a result of combustion thereof, while the lean air-fuel mixture produces exhaust gases containing a relatively large quantity of hydrocarbons and a relatively small quantity of carbon monoxide as a result of combustion thereof. These hydrocarbons and carbon monoxide can be relatively readily rendered harmless by oxidation in the exhaust gas reburning device.

From the foregoing, it has been proposed to employ the rich or lean air-fuel mixture to reduce the production of nitrogen oxides by combustion and furthermore to provide an exhaust gas reburning device such as a thermal reactor in the engine exhaust system to reburn or oxidize hydrocarbons and carbon monoxide contained in the engine exhaust gases to render harmless.

However, in this instance, there is the problem that the lower the temperature of reaction is and the lower the content of carbon monoxide contained in the engine exhaust gases is, the more the oxidation of carbon monoxide in the exhaust gas reburning device is difficult to occur.

Accordingly, in order to most effectively reduce total amounts of nitrogen oxides, hydrocarbons and carbon monoxide contained in engine exhaust gases, it is considered to employ the rich air-fuel mixture for the engine to produce exhaust gases of a high temperature containing large quantities of hydrocarbons and carbon monoxide and to effectively treat these air pollutants in the exhaust gas reburning device under supply of secondary air. However, this solution has a disadvantage that fuel consumption is increased since the rich air-fuel mixture only is employed. On the contrary, when the lean air-fuel mixture only is employed for the engine, there is the disadvantages that treatment of carbon monoxide is difficult as stated above and the output performance of the engine is somewhat reduced.

Thus, it has been proposed to feed a combustion chamber or some chambers with the rich air-fuel mixture and the remaining combustion chamber or chambers with the lean air-fuel mixture to mix two kinds of differently composed exhaust gases resulting respectively from combustion of the rich and lean air-fuel mixtures with each other to reburn these exhaust gases in the exhaust gas reburning device for effectively treating both hydrocarbons and carbon monoxide and preventing a reduction in fuel consumption as well as reducing the production of nitrogen oxides. However, this solution has had a disadvantage that carbon monoxide is not sufficiently and effectively oxidized in the exhaust gas reburning device so that the content of carbon monoxide contained in the exhaust gases discharged therefrom is increased when the engine exhaust gases are at a relatively low temperature as during low speed and low load running or starting operation of the engine.

This is because of two kinds of differently composed exhaust gases of the rich and lean air-fuel mixture being directly mixed with each other in the exhaust gas reburning device so that large quantities of hydrocarbons and carbon monoxide in the exhaust gases of the rich air-fuel mixture are diluted by the exhaust gases of the lean air-fuel mixture to cause a reduction in the temperature of these two harmful burnable components to degrade ignitability of the burnable components and preservability of flame. Accordingly, it is considered for preventing this phenomenon to increase the production of carbon monoxide by enriching the rich air-fuel mixture and to improve heat resistance of the exhaust gas reburning device. However, this solution has disadvantages that fuel economy is reduced and the construction of the reburning device is complicated.

It is, therefore, an object of the invention to provide an exhaust gas reburning system comprising an exhaust gas reburning device which comprises a first reaction chamber receiving rich HC and CO containing engine exhaust gases, resulting from combustion of the rich air-fuel mixture, and secondary air to cause oxidation of rich HC and CO in the exhaust gases to a certain degree, and a second reaction chamber receiving the resultant engine exhaust gases from said first reaction chamber and poor HC and CO containing engine exhaust gases resulting from combustion of the lean air-fuel mixture to cause mixture of these two kinds of engine exhaust gases so that the rich HC and CO containing exhaust gases is preventing from being diluted by the poor HC and CO containing engine exhaust gases to improve ignitability of burnable components in the exhaust gases and preservability of frame to cause sufficient oxidation of carbon monoxide in the second reaction chamber even when the engine exhaust gases are at a relatively low temperature as during low speed and low load running or starting operation of the engine.

This and other objects and advantages of the invention will become more apparent from the following detailed description taken in connection with the accompanying drawings in which.

Figure 1:
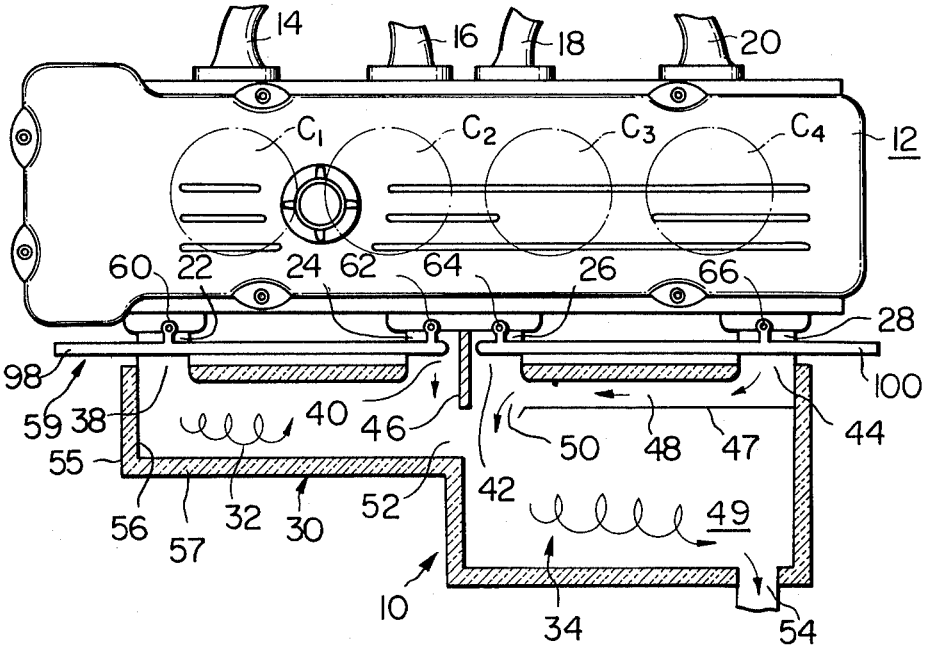
FIG. 1 is a schematic view of a first preferred embodiment of an exhaust gas reburning device forming part of an exhaust gas reburning system according to the invention.

Referring to FIG. 1 of the drawings, there is shown an exhaust gas reburning device or thermal reactor forming part of an exhaust gas reburning system according to the invention, generally designated by the reference numeral 10, and an internal combustion engine 12 combined with the exhaust gas thermal reactor 10. The engine 12 is shown as including four cylinders or combustion chambers $C_1$, $C_2$, $C_3$ and $C_4$, induction passageways 14, 16, 18 and 20 communicating respectively with intake ports (not shown) of the individual combustion chambers $C_1$ and $C_4$ and exhaust gas passageways or conduits 22, 24, 26 and 28 communicating respectively with exhaust ports (not shown) of the individual combustion chambers $C_1$ to $C_4$. The combustion chambers $C_1$ to $C_4$ are arranged in the combustion chambers $C_1$ and $C_2$ of a first group and the combustion chambers $C_3$ and $C_4$ of a second group. The combustion chambers $C_1$ and $C_2$ are fed or filled with a rich air-fuel mixture having an air-fuel ratio lower than a predetermined air-fuel ratio which in the embodiment is a stoichiometric air-fuel ratio, while the combustion chambers $C_3$ and $C_4$ are fed or filled with a lean air-fuel mixture having an air-fuel ratio higher than the stoichiometric air-fuel ratio.

The exhaust gas thermal reactor 10 comprises a housing 30 which is formed therein with first and second reaction chambers 32 and 34 adjoining each other separated from each other and inlet ports 38, 40, 42 and 44. The inlet ports 38 and 40 communicate respectively with the exhaust gas passageways 22 and 24 of the engine 12 and open into the first reaction chamber 32 to admit thereinto exhaust gases resulting from combustion of the rich air-fuel mixture in the combustion chambers $C_1$ and $C_2$ which gases contain relatively large quantities burnable components such as of hydrocarbons (HC) and carbon monoxide (CO). The inlet ports 42 and 44 communicate respectively with the exhaust gas passageways 26 and 28 of the engine 12 and open into the second reaction chamber 34 to admit thereinto exhaust gases resulting from combustion of the lean air-fuel mixture in the combustion chambers $C_3$ and $C_4$ which gases contain relatively small quantities of hydrocarbons and carbon monoxide. A main partition member 46 is located in the housing 30 and extends perpendicularly to a longitudinal direction of the thermal reactor 10 and separates the first and second reaction chambers 32 and 34 from each other. A partition member 47 is located in the second reaction chamber 34 at a position adjacent to the inlet ports 42 and 44 and extends in parallel to the longitudinal direction of the thermal reactor 10 from an internal surface of a wall of the reaction chamber 34 toward the partition member 46 to divide the reaction chamber 34 into auxiliary and main reaction chambers 48 and 49. The auxiliary reaction chamber 48 is in the form of a passageway and the inlet ports 42 and 44 open thereinto to directly receive the engine exhaust gases from the combustion chamber $C_3$ and $C_4$. The partition member 47 is formed at an end thereof adjacent to or opposed to the partition member 46 with an outlet port 50 to provide fluid communication between the auxiliary and main reaction chambers 48 and 49 so that all engine exhaust gases delivered from the inlet ports 42 and 44 into the reaction chamber 48 are spouted from the outlet port 50 into the reaction chamber49. The partition member 46 is formed at a position adjacent to the outlet port 50 with an outlet port 52 to provide fluid communication between the first and main reaction chambers 32 and 49 so that the engine exhaust gases delivered from the reaction chamber 32 into the reaction chamber 49 strike against or meet with and are sufficiently mixed with the engine exhaust gases spouted from the outlet port 50. The housing 30 is also formed with a discharge port 54 which opens from the reaction chamber 49 at a position most remote from the outlet ports 50 and 52 into the outside of the housing 30 and discharges the engine exhaust gases treated in the reaction chamber 49 into the outside of the device 10. The outlet port 54 may be connected to an exhaust gas passageway or conduit (not shown) vented to the outside atmosphere by way of a silencer. The wall of the housing 30 comprises external and internal wall members 54 and 56, and a heat insulator 57 interposed therebetween.

It is desirable or necessary that the inlet ports 38, 40, 42 and 44 of the exhaust gases thermal reactor 10 communicate respectively with the exhaust ports of the combustion chambers $C_1$, $C_2$, $C_3$ and $C_4$ of the engine 12 at positions immediately downstream of the exhaust ports, as shown in the drawing. This is to effectively utilize the heat of the engine exhaust gases for combustion of the exhaust gases in the reaction chambers 32, 48 and 49 so that heating means such as an ignition plug can be omitted. Since the thermal reactor 10 is constructed to have the inlet ports 48, 40, 42 and 44 connected respectively with every exhaust ports of the engine 12, the longitudinal direction of the thermal reactor 10 is parallel to the longitudinal axis of the engine 12 or the inlet ports 38, 40, 42 and 44 are arranged parallel to the longitudinal axis of the engine 12.

The exhaust gas reburning system also comprises a secondary air supply control device 59 comprising secondary air injection nozzles 60, 62, 64 and 66 which open respectively into the exhaust gas passageway 22, 24, 26 and 28 at positions adjacent to the exhaust ports to feed or inject secondary air into the engine exhaust gases to assist and promote reaction of the exhaust gases in the reaction chambers 32, 48 and 49.

Generally, the lower and speed and load of an engine are, the lower the temperature of engine exhaust gases is, and the engine exhaust gas temperature is increased with increases in the speed and load of the engine. Accordingly, since the reaction or reburning of the engine exhaust gases in a thermal reactor is difficult to occur during low speed and low load running of the engine, it is necessary in an engine such as the engine 12 to enrich the rich air-fuel mixture over it during low speed and low load running of the engine. This is accomplished by, for example, in an engine provided with a carburetor, adjusting the idle system or low speed circuit thereof to provide an air-fuel mixture richer than the rich air-fuel mixture provided by the main system or high speed circuit of the carburetor, since the air-fuel mixture for the engine is provided by the idle system during the low speed and low load running of the engine when engine throttle valve is opened a small amount. Because of such an enrichment of the rich air-fuel mixture, it is necessary to increase the amount of secondary air fed into the engine exhaust gases resulting from combustion of the rich air-fuel mixture enriched during low speed and low load running of the engine. On the contrary, since the reaction of the engine exhaust gases in the thermal reactor is rendered active during high speed and high load running of the engine, it is unnecessary to enrich the rich air-fuel mixture and accordingly to increase the amount of secondary air at this time.

Figure 3:
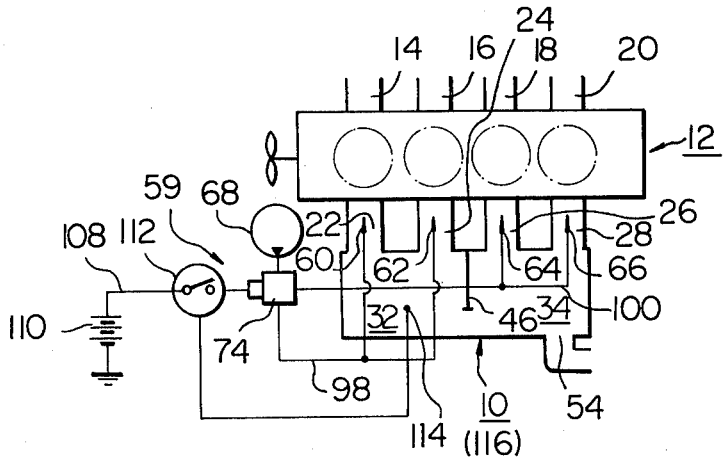
FIG. 3 is a schematic view of a preferred embodiment of a secondary air supply control device forming part of an exhaust gas reburning system according to the invention.
Figure 4:
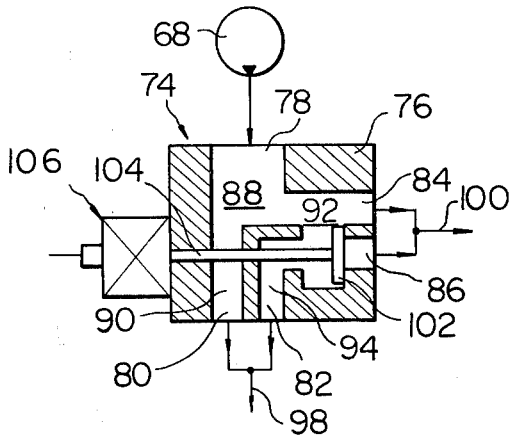
FIG. 4 is a schematic view of a flow control valve forming part of the secondary air supply control device shown in FIG. 3.

For this purpose, the injection nozzles 60, 62, 64 and 66 are connected to an air pump 68 by way of a flow control valve 74, as shown in FIG. 3 of the drawings, which controls the flow of secondary air fed into the engine exhaust gases in accordance with an operating condition of the engine 12. As best shown in FIG. 4 of the drawings, the flow control valve 74 comprises a valve body 76 which is formed with an inlet port 78, outlet ports 80, 82, 84 and 86, a passage 88 communicating with the inlet port 78, first and second branch passages 90 and 92 diverging from the passage 88 and communicating respectively with the outlet ports 80 and 84, and third and fourth branch passages 94 and 96 diverging from a mid portion of the second branch passage 92 and communicating respectively with the outlet ports 82 and 86. The inlet port 78 is connected to an outlet or discharge port of the air pump 68 and is fed with secondary air under pressure discharged from the the air pump 86. The outlet ports 80 and 82 are connected to the injection nozzles 60 and 62 by way of a secondary air distributor 98, while the outlet ports 84 and 86 are connected to the injection nozzles 64 and 66 by way of a secondary air distributor 100. The second branch passage 92 communicates alternatively with the third and fourth branch passages 94 and 96. The flow control valve 74 comprises a valve head 102 operably located in the passages 94 and 96, for this purpose. The valve head 102 assumes a first position to close the passage 96 and to open the passage 94 to communicate the passage 92 with the passage 94 during low speed and slow load running of the engine 12 and a second position to close the passage 94 and to open the passage 96 to communicate the passage 92 with the passage 96 during high speed and high load running of the engine 12. A valve stem 104 is securely connected to the valve head 102 and extends externally of the valve body 76 and is fixedly connected to the core (not shown) of a solenoid 106 which is provided for operating the flow control valve 74. An electric control circuit 108 is connected to the solenoid 106 and includes therein an electric power source such as a battery 110, and a switch 112 interposed therebetween. The switch 112 responds to the temperature of the engine exhaust gases and accordingly the temperature resulting from reaction of the exhaust gases with secondary air in the thermal reactor 10 and closes only when the temperature of the engine exhaust gases is above a predetermined level. Temperature sensing means 114 is located in the first main reaction chamber 32 and responds to the temperature in the reaction chamber 32 in excess of the predetermined level to generate an electric output signal. The sensing means 114 is electrically connected to the switch 112 to apply the output signal to its to actuate the switch 112 to close. The solenoid 106 is deenergized to hold the flow control valve 74 in the first position when the switch 112 is opened and is energized to move the flow control valve 74 into the second position when the switch 112 is closed.

The exhaust gas thermal reactor 10 thus far described is operated as follows:

The exhaust gases containing relatively large quantities of hydrocarbons and carbon monoxide are passed from the combustion chambers $C_1$ and $C_2$ of the engine 12 into the first reaction chamber 32. Secondary air is fed into the exhaust gas passageways 22 and 24 through the injection nozzles 60 and 62, respectively. A relatively large part of each of hydrocarbons and carbon monoxide in the engine exhaust gases in the reaction chamber 32 is actively oxidized in the presence of oxygen in the secondary air to increase the temperature of the exhaust gases to a higher level. The resultant engine exhaust gases are passed or spouted from the outlet port 52 into the main reaction chamber 49. On the other hand, the exhaust gases containing relatively small quantities of hydrocarbons and carbon monoxide are passed from the combustion chambers $C_3$ and $C_4$ into the auxiliary reaction chamber 48. Secondary air is fed into the exhaust gas passageways 26 and 28 through the injection nozzles 64 and 66, respectively. Some or slight part of each of hydrocarbons and carbon monoxide in the engine exhaust gases is inducted to oxidize in the presence of oxygen in the secondary air in the reaction chamber 48. At this state, the engine exhaust gases in the reaction chamber 48 are spouted from the outlet port 50 into the main reaction chamber 49 and strike against and are sufficiently mixed with the engine exhaust gases from the first reaction chamber 32. As a result, hydrocarbons and carbon monoxide in the engine exhaust gases from the reaction chamber 32 which are left unburned are burned in the presence of oxygen in excessive air in the engine exhaust gases from the reaction chamber 48 to increase the temperature of the engine exhaust gases in the reaction chamber 49 to a higher level. The heat of the resultant engine exhaust gases burns hydrocarbons and carbon monoxide in the engine exhaust gases from the reaction chamber 48. Thus, the exhaust gas thermal reactor 10 provides therein purified engine exhaust gases containing extremely small quantities of hydrocarbons and carbon monoxide and little nitrogen oxides which gases are discharged from the outlet port 54 into the outside of the thermal reactor 10.

Referring to the amount of secondary air added, when the engine 12 is running at a low speed and a low load with the exhaust gases at a relatively low temperature, the switch 112 is opened so that owing to deenergization of the solenoid 106 the flow control valve 74 opens the third branch passage 94 and closes the fourth branch passage 96. As a result, the amount of the secondary air fed into the exhaust gas passageways 22 and 24 is increased to promote reburning of the exhaust gases resulting from combustion of the enriched rich air-fuel mixture in the combustion chambers $C_1$ and $C_2$ of the engine 12. When the engine 12 is running at a high speed and a high load with the exhaust gases at a relatively high temperature, the switch 112 is closed so that owing to energization of the solenoid 106 the flow control valve 74 closes the passage 94 and opens the passage 96. As a result, although the amount of the secondary air fed into the exhaust gas passageways 26 and 28 is increased, the amount of the secondary air fed into the exhaust gas passageways 22 and 24 is reduced to prevent overheating of the thermal reactor 10.

Figure 2:
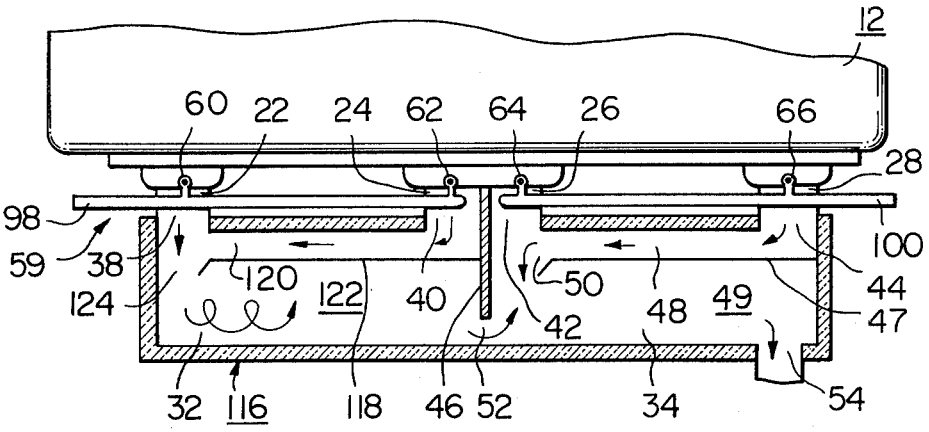
FIG. 2 is a schematic view of a second preferred embodiment of an exhaust gas reburning device forming part of an exhaust gas reburning system according to the invention.

Referring to FIG. 2 of the drawings, there is shown a second preferred embodiment of an exhaust gas thermal reactor according to the invention. In FIG. 2, like component elements are designated by the same reference numeral as those used in FIG. 1. As shown in FIG. 2, the exhaust gas thermal reactor, generally designated by the reference numeral 116, is different from the thermal reactor 10 shown in FIG. 1 in the fact that a partition member 118 is located in the first reaction chamber 32 at a position adjacent to the inlet ports 38 and 40 and extends in parallel to the longitudinal direction of the housing 30 from the partition member 46 toward a wall of the reaction chamber 32 to divide the reaction chamber 32 into auxiliary and main reaction chambers 120 and 122. The inlet ports 38 and 40 open into the reaction chamber 120. The partition member 118 is formed at an end thereof opposed to or adjacent to the wall of the reaction chamber 32 at a position most remote from the partition member 46 with an outlet port 124 to provide fluid communication between the auxiliary and main reaction chambers 120 and 122. By this construction, the thermal reactor 116 has an advantage that all engine exhaust gases delivered from the combustion chambers $C_1$ and $C_2$ into the reaction chamber 120 are spouted from the outlet port 124 into the reaction chamber 122 so that the engine exhaust gases from the inlet port 40 are prevented from being directly passed from the outlet port 52 into the reaction chamber 49 along the partition member 46 to secure and promote the reaction of the engine exhaust gases in the first reaction chamber 32.

Although since the exhaust gases resulting from combustion of the lean air-fuel mixture initially contain excessive air or oxygen, supply of secondary air into the exhaust gases may be omitted, it is desirable or necessary for inducing some combustion of the exhaust gases in the reaction chamber 48 and for, when the engine exhaust gases from the reaction chamber 32 are mixed with the engine exhaust gases from the reaction chamber 36 in the reaction chamber 49, maintaining the total amount of air or oxygen in these two kinds of engine exhaust gases at an adequate value to feed secondary air into the exhaust gases resulting from combustion of the lean air-fuel mixture. Accordingly, feed of secondary air into the exhaust gases resulting from the lean air-fuel mixture can be omitted by adjusting the air-fuel ratios of the rich and lean air-fuel mixtures and the amount of secondary air fed into the exhaust gases resulting from the rich air-fuel mixture to adequate values. In this instance, when the engine 12 includes a carburetor as adjusted in such a manner as to increase the air-fuel ratio of the rich air-fuel mixture as the speed and load of the engine is increased, the amount of secondary air fed into the exhaust gases resulting from the lean air-fuel mixture can be reduced by omitting the outlet port 86 of the valve body 76 of the flow control valve 74 or opening the port 86 into the outside atmosphere.

Although the invention has been described as being applied to a four cylinder or combustion chamber engine, the invention can be applied to other multi-cylinder or combustion chamber engines such as a six cylinder engine or an eight cylinder engine by adding slight changes.

It will be appreciated that the invention provides an exhaust gas reburning system comprising an exhaust gas reburning device in which only rich HC and CO containing engine exhaust gases, resulting from combustion of the rich air-fuel mixture, together with secondary air are admitted into a first reaction chamber and are effectively burned therein to increase the temperature of the engine exhaust gases to a higher level and the remaining HC and CO in the engine exhaust gases from the first reaction chamber and small quantities of HC and CO in poor HC and CO containing engine exhaust gases resulting from combustion of the clean air-fuel mixture are effectively burned in a second reaction chamber by heat of the engine exhaust gases from the first reaction chamber and oxygen in the poor HC and CO containing engine exhaust gases so that HC and CO in the engine exhaust gases are sufficiently oxidized to effectively accomplish purification of the engine exhaust gases, i.e., reductions in the NO*x*, HC and CO contents in the engine exhaust gases even when the engine exhaust gases are at a relatively low temperature as during low speed and low load running or starting operation of the engine.

It will be also appreciated that the invention provides an exhaust gas reburning system comprising a secondary air control supply device by which secondary air fed into the rich HC and CO containing engine exhaust gases is increased with enrichment of the rich air-fuel mixture so that the temperature of the engine exhaust gases in the first reaction chamber is abruptly increased to a temperature to maintain and promote reaction to secure and improve ignitability of burnable components in the engine exhaust gases and preservability of combustion or flame in the exhaust gas reburning device when the engine exhaust gases are at a relatively low temperature as during low speed and low load running or starting operation of the engine, and secondary air fed into the rich HC and CO containing engine exhaust gases is reduced so that local overheating owing to excessive reaction is prevented during high speed and high load running of the engine.

What is claimed is:

1. An exhaust gas reburning device for an internal combustion engine comprising a first combustion chamber producing first engine exhaust gas containing relatively large quantities of burnable components, a second combustion chamber producing second engine exhaust gas containing relatively small quantities of burnable components, a housing having therein first and second reaction chambers adjoining each other and communicating respectively with said first and second combustion chambers, a main partition member imperforate over a major portion of its area separating said first and second reaction chambers from each other and having a first port opening from said first reaction chamber into said second reaction chamber, a first partition member located in said second reaction chamber and extending from an internal surface of a wall of said second reaction chamber toward said main partition member, and a second partition member located in said first reaction chamber and extending from said main partition member toward a wall of said first reaction chamber, said housing having a discharge port opening from said second reaction chamber externally of said housing.

2. An exhaust gas reburning device for an internal combustion engine comprising a first combustion chamber producing first engine exhaust gas containing relatively large quantities of burnable components, a second combustion chamber producing second engine exhaust gas containing relatively small quantities of burnable components, a housing having therein first and second reaction chambers adjoining each other, first passage means providing communication between said first combustion chamber and said first reaction chamber, second passage means providing communication between said second combustion chamber and said second reaction chamber, a main partition member imperforate over a major portion of its area separating said first and second reaction chambers from each other and having a first port opening from said first reaction chamber into said second reaction chamber, a first partition member located in said second reaction chamber and extending from an internal surface of a wall of said second reaction chamber toward said main partition member and dividing said second reaction chamber into main and auxiliary reaction chambers, said auxiliary reaction chamber directly communicating with said second combustion chamber, said first partition member being formed at an end thereof adjacent to said main partition member with a second port to provide fluid communication between said main and auxiliary reaction chambers to admit said first engine gas from said auxiliary reaction chamber into said main reaction chamber, and a second partition member located in said first reaction chamber and extending from said main partition member toward a wall of said first reaction chamber and dividing it into main and auxiliary reaction chambers, said auxiliary reaction chamber directly communicating with said first combustion chamber, said second partition member being formed at an end thereof adjacent to a wall of said first reaction chamber at a position most remote from said main partition member with a third outlet port to provide fluid communication between said main and auxiliary reaction chambers of said first reaction chamber to admit said first engine gas from said auxiliary reaction chamber into said main reaction chamber, said housing having a discharge port opening from said second reaction chamber externally of said housing, and a secondary air supply control device for feeding secondary air into said first passage means.

3. A combination of an exhaust gas reburning device with an internal combustion engine, the engine including a first combustion chamber producing first engine exhaust gas containing relatively large quantities of burnable components, and a second combustion chamber producing second engine exhaust gas containing relatively small quantities of burnable components, said exhaust gas reburning device comprising a housing having therein first and second reaction chambers adjoining each other, first passage means providing communication between said first combustion chamber and said first reaction chamber, second passage means providing communication between said second combustion chamber and said second reaction chamber, a main partition member separating said first and second reaction chambers from each other and having a first port opening from said first reaction chamber into said second reaction chamber, a first partition member located in said second reaction chamber and extending from an internal surface of a wall of said second reaction chamber toward said main partition member, and a second partition member located in said first reaction chamber and extending from said main partition member toward a wall of said first reaction chamber, said housing having a discharge port opening from said second reaction chamber externally of said housing, and a secondary air supply control device for feeding secondary air into said first passage means.

4. An exhaust gas reburning device for an internal combustion engine comprising a first combustion chamber producing first engine exhaust gas containing relatively large quantities of burnable components, a second combustion chamber producing second engine exhaust gas containing relatively small quantities of burnable components, a housing having therein first and second reaction chambers adjoining each other, first passage means providing communication between said first combustion chamber and said first reaction chamber, second passage means providing communication between said second combustion chamber and said second reaction chamber, a main partition member separating said first and second reaction chambers from one another and having a first port opening from said first reaction chamber into said second reaction chamber, said housing having a discharge port opening from said second reaction chamber externally of said housing, and a secondary air supply control device for feeding secondary air into said first and second passage means, said supply control device comprising first and second secondary air injection nozzles opening respectively into said first and second passage means, a source of secondary air under pressure communicating with said secondary air injection nozzles and a flow control valve disposed between said source of secondary air under pressure and said secondary air injection nozzles, and operable to increase and reduce the flow of air fed into said first and second passage means when the temperature of said first and second engine exhaust gases is below and above a predetermined level, respectively, in which said flow control valve comprises a valve body formed therein with an inlet port communicating with said source of secondary air under pressure, first and second outlet ports communicating with said secondary air injection nozzle, a third outlet port communicating with said second secondary air injection nozzle, a passage communicating with said inlet port, first and second branch passages diverging from said passage and communicating respectively with said first and third outlet ports, and a third branch passage diverging from said second branch passage and communicating with said second outlet port, a valve head operable between first and second positions to open and close said third branch passage, respectively, and actuating means operating said valve head into said first position in response to a temperature of said engine exhaust gases below said predetermined level into said second position in response to a temperature of said engine exhaust gases above said predetermined level.

5. A combination of an exhaust gas reburning device with an internal combustion engine, the engine including a first combustion chamber producing first engine exhaust gas containing relatively large quantities of burnable components, and a second combustion chamber producing second engine exhaust gas containing relatively small quantities of burnable components, said exhaust has reburning device comprising a housing having therein first and second reaction chambers adjoining each other, first passage means providing communication between said first combustion chamber and said first reaction chamber, second passage means provided in communication between said second combustion chamber and said second reaction chamber, a main partition member separating said first and second reaction chambers from each other and having a first port opening from said first reaction chamber to said second reaction chamber, said housing having a discharge port opening from said second reaction chamber externally of said housing and a second air supply control device for feeding secondary air into said first and second passage means, in which said secondary air supply control device comprises first and second secondary air injection nozzles opening respectively into said first and second passage means adjacent the exhaust ports of said first and second combustion chambers, a source of secondary air under pressure communicating with said secondary air injection nozzles, and a flow control valve disposed between said source of secondary air under pressure and said secondary air injection nozzles, and operable to increase and reduce the flow of secondary air fed into said first and second passage means when the temperature of said first and second engine exhaust gases is below and above a predetermined level, respectively, in which said flow control valve comprises a valve body formed therein with an inlet port communicating with said source of secondary air under pressure, first and second outlet ports communicating with said first secondary air injection nozzle, a third outlet port communicating with said second secondary air injection nozzle, a passage communicating with said inlet port, first and second branch passages diverging from said passage and communicating respectively with said first and third outlet ports, and a third branch passage diverging from said second branch passage, and communicating with said second outlet port, a valve head operable between first and second portions to open and to close said third branch passage, respectively, and actuating means operating said valve head into said first position in response to a temperature of said engine exhaust gases below said predetermined level and into said and into said second position in response to a temperature of said engine exhaust gases above said predetermined level.

6. An exhaust gas reburning device as claimed in claim 2, in which said discharge port is formed through a wall of said main reaction chamber of said second reaction chamber at a position most remote from said first and second ports.

7. An exhaust gas reburning system as claimed in claim 4, in which said valve body is further formed therein with a fourth outlet port communicating with said second secondary air injection nozzle, and a fourth branch passage diverging from said second branch passageway and communicating with said fourth outlet port, said valve head closing and opening said fourth branch passage when is in said first and second positions, respectively.

8. A combination as claimed in claim 3, in which said first partition member divides said reaction chamber into main and auxiliary reaction chambers, said auxiliary reaction chamber directly communicating with said second passage means, said first main partition being formed at an end thereof adjacent to said main partition member with a second port to provide fluid communication between said main and auxiliary reaction chambers to admit said first engine exhaust gas from said auxiliary reaction chamber into said main reaction chamber.

9. A combination as claimed in claim 8, in which said second partition member divides said first reaction chamber into main and auxiliary reaction chambers, said auxiliary reaction chamber directly communicating with said first passage means to receive said first engine exhaust gas from said first combustion chamber, said second partition member being formed at an end thereof adjacent to a wall of said first reaction chamber at a position most remote from said main partition member with a third port to provide fluid communication between said main and auxiliary reaction chambers of said first reaction chamber to admit said first engine exhaust gas from said auxiliary reaction chamber into said main reaction chamber.

10. A combination as claimed in claim 8, in which said discharge port is formed through a wall of said main reaction chamber of said second reaction chamber at a position most remote from said first and second ports.

11. A combination as claimed in claim 3, in which said engine has four combustion chambers in total arranged in a first group of two combustion chambers and a second group of two combustion chambers, said exhaust gas reburning device having four inlet ports arranged in a first group of two inlet ports and a second group of two inlet ports, said first group of two inlet ports opening into said first reaction chamber and communicating respectively with said two combustion chambers of said first group, said second group of two inlet ports opening into said second reaction chamber and communicating respectively with said two combustion chambers of said second group.

12. A combination as claimed in claim 11, in which said four inlet ports are arranged substantially in parallel to the longitudinal axis of said engine.

13. A combination as claimed in claim 12, in which said four inlet ports are positioned immediately downstream of the respective exhaust ports of the corresponding combustion chambers.

* * * * *